US010837733B2

(12) United States Patent
McPherson et al.

(10) Patent No.: US 10,837,733 B2
(45) Date of Patent: Nov. 17, 2020

(54) CROSSBOW TRIGGER WITH DECOCKING MECHANISM

(71) Applicant: MCP IP, LLC, Sparta, WI (US)

(72) Inventors: Mathew A. McPherson, Norwalk, WI (US); Mark J. Hayes, Sparta, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/373,506

(22) Filed: Apr. 2, 2019

(65) Prior Publication Data

US 2019/0226794 A1 Jul. 25, 2019

Related U.S. Application Data

(63) Continuation of application No. 15/663,202, filed on Jul. 28, 2017, now Pat. No. 10,247,507, which is a continuation of application No. 15/347,686, filed on Nov. 9, 2016, now Pat. No. 9,726,454.

(60) Provisional application No. 62/317,350, filed on Apr. 1, 2016, provisional application No. 62/254,029, filed on Nov. 11, 2015.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12
See application file for complete search history.

(56) References Cited

U.S. PATENT DOCUMENTS

| | | | |
|---|---|---|---|
| 3,670,711 | A | 6/1972 | Firestone |
| 4,030,473 | A | 6/1977 | Puryear |
| 4,169,456 | A | 10/1979 | Van House |
| 4,192,281 | A | 3/1980 | King |
| 4,388,914 | A | 6/1983 | Cesin |
| 4,479,480 | A | 10/1984 | Holt |
| 4,662,345 | A | 5/1987 | Stephens |
| 4,665,886 | A | 5/1987 | Barlow |
| 4,688,539 | A | 8/1987 | Lawrence |
| 4,693,228 | A | 9/1987 | Simonds et al. |
| 4,697,571 | A | 10/1987 | Waiser |
| 4,716,880 | A | 1/1988 | Adkins |
| 4,721,092 | A | 1/1988 | Waiser |
| 4,877,008 | A | 10/1989 | Troubridge |
| 5,025,771 | A | 6/1991 | Hanson |
| 5,085,200 | A | 2/1992 | Horton-Corcoran |
| 5,243,956 | A | 9/1993 | Luehring |
| 5,596,976 | A | 1/1997 | Waiser |
| 5,598,829 | A | 2/1997 | Bednar |

(Continued)

FOREIGN PATENT DOCUMENTS

CN 202993971 6/2013

*Primary Examiner* — John A Ricci

(57) ABSTRACT

In some embodiments, a crossbow trigger mechanism comprises a housing, a trigger, a latch and a latch retaining mechanism. The housing defines a slot. The latch comprises a string catch and a trigger engaging portion. The latch is moveable with respect to the housing between first and second positions. In the first position, the trigger engaging portion contacts the trigger. In the second position, the trigger engaging portion does not contact the trigger. The latch retaining mechanism is arranged to retain the latch in the second position.

15 Claims, 19 Drawing Sheets

(56) References Cited

U.S. PATENT DOCUMENTS

| | | | |
|---|---|---|---|
| 5,649,520 | A | 7/1997 | Bednar |
| 5,884,614 | A | 3/1999 | Darlington |
| 6,205,990 | B1 | 3/2001 | Adkins |
| 6,425,386 | B1 | 7/2002 | Adkins |
| 6,736,123 | B1 | 5/2004 | Summers |
| 6,799,566 | B1 | 10/2004 | Malucelli |
| 6,802,304 | B1 | 10/2004 | Chang |
| 7,017,568 | B1 | 3/2006 | Smith |
| 7,174,884 | B2 | 2/2007 | Kempf |
| 7,588,022 | B2 | 9/2009 | Chang |
| 7,770,567 | B1 | 8/2010 | Yehle |
| 7,779,824 | B2 | 8/2010 | Bednar |
| 7,784,453 | B1 | 8/2010 | Yehle |
| 7,810,480 | B2 | 10/2010 | Shepley |
| 7,814,894 | B2 | 10/2010 | Giroux |
| 7,997,258 | B2 | 8/2011 | Shepley |
| 8,020,543 | B2 | 9/2011 | Maleski |
| 8,091,540 | B2 | 1/2012 | Matasic |
| 8,240,299 | B2 | 8/2012 | Kronengold |
| 8,312,869 | B2 | 11/2012 | Gillet |
| 8,375,928 | B1 | 2/2013 | Bednar et al. |
| 8,453,631 | B1 | 6/2013 | Kronengold |
| 8,522,761 | B1 | 9/2013 | Chu |
| 8,602,013 | B2 | 12/2013 | Bednar |
| 8,651,094 | B2 | 2/2014 | Matasic |
| 8,656,899 | B2 | 2/2014 | Bednar |
| 8,770,178 | B2 | 7/2014 | Kempf |
| 8,857,420 | B2 | 10/2014 | Grace |
| 8,931,465 | B1 | 1/2015 | Choma |
| 8,985,091 | B2 | 3/2015 | Miao |
| 9,010,308 | B1 | 4/2015 | Hyde |
| 9,354,018 | B2 | 5/2016 | Khoshnood |
| 9,360,268 | B2 | 6/2016 | Khoshnood |
| 9,435,605 | B2 | 9/2016 | McPherson et al. |
| 9,726,454 | B2 | 8/2017 | McPherson |
| 10,247,507 | B2 | 4/2019 | McPherson et al. |
| 2009/0064978 | A1 | 3/2009 | Matasic |
| 2009/0078243 | A1 | 3/2009 | Bednar |
| 2012/0048252 | A1 | 3/2012 | Chu |
| 2013/0098343 | A1 | 4/2013 | Grace |
| 2013/0312724 | A1 | 11/2013 | Hudkins |
| 2014/0076296 | A1 | 3/2014 | Kempf |
| 2014/0102431 | A1 | 4/2014 | Kennedy |
| 2014/0182574 | A1 | 7/2014 | Darlington |
| 2014/0246003 | A1 | 9/2014 | Lipowski |

CROSSBOW TRIGGER WITH DECOCKING MECHANISM

CROSS-REFERENCE TO RELATED APPLICATIONS

This application is a continuation of U.S. patent application Ser. No. 15/663,202, filed Jul. 28, 2017, which is a continuation of U.S. patent application Ser. No. 15/347,686, filed Nov. 9, 2016, now U.S. Pat. No. 9,726,454, which claims the benefit of U.S. Provisional Patent Application No. 62/254,029, filed Nov. 11, 2015, and the benefit of U.S. Provisional Patent Application No. 62/317,350, filed Apr. 1, 2016, the entire disclosures of which are hereby incorporated herein by reference.

BACKGROUND OF THE INVENTION

This invention relates generally to trigger mechanisms and more specifically to a trigger suitable for use with a crossbow.

Crossbows are generally known in the art, as well as trigger mechanisms arranged to control the firing of a crossbow. A crossbow can be cocked, wherein a bowstring can be retained in a drawn orientation by a string catch. The crossbow can be fired by operating a trigger, which releases the string catch, thereby releasing the bowstring.

When a crossbow is cocked, it may be desirable to let down the bowstring without launching an arrow. One known method for releasing a bowstring is to use a cocking aid, such as a cocking rope or crank, to pull the bowstring, then physically operate the trigger to release the string catch, relying on the cocking aid to retain the bowstring and let it down safely.

There remains a need for novel trigger mechanisms that provide for lightweight, smooth operation and improved trigger feel when compared to traditional triggers. There remains a need for novel trigger mechanisms that allow decocking of a crossbow without operating the trigger.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow trigger mechanism comprises a trigger and a latch. The trigger comprises a trigger sear. The latch is arranged to rotate about a latch axis. The latch comprises a latch sear, a string catch and a disengage portion. The latch sear is arranged to contact the trigger sear. The disengage portion comprises a cantilever arm.

In some embodiments, a detent is provided to engage the latch.

In some embodiments, the latch further comprises a reset portion, the reset portion comprising a cantilever arm.

In some embodiments, a crossbow trigger mechanism comprises a housing, a trigger, a latch and a latch retaining mechanism. The housing defines a slot. The latch comprises a string catch and a trigger engaging portion. The latch is moveable with respect to the housing between first and second positions. In the first position, the trigger engaging portion contacts the trigger. In the second position, the trigger engaging portion does not contact the trigger. The latch retaining mechanism is arranged to retain the latch in the second position.

In some embodiments, the string catch is not positioned in the slot when the latch is in the second position.

In some embodiments, the latch retaining mechanism comprises a detent.

In some embodiments, a latch spring biases the latch to the first position.

In some embodiments, the trigger mechanism comprises a disengage selector that is moveable between first and second orientations. In the first orientation, the disengage selector prevents the latch from assuming the second position.

In some embodiments, the trigger mechanism comprises an arrow sensor, and the arrow sensor is arranged to contact the disengage selector.

In some embodiments, the latch further comprises a reset portion that is positioned in the slot when the latch is in the second position.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
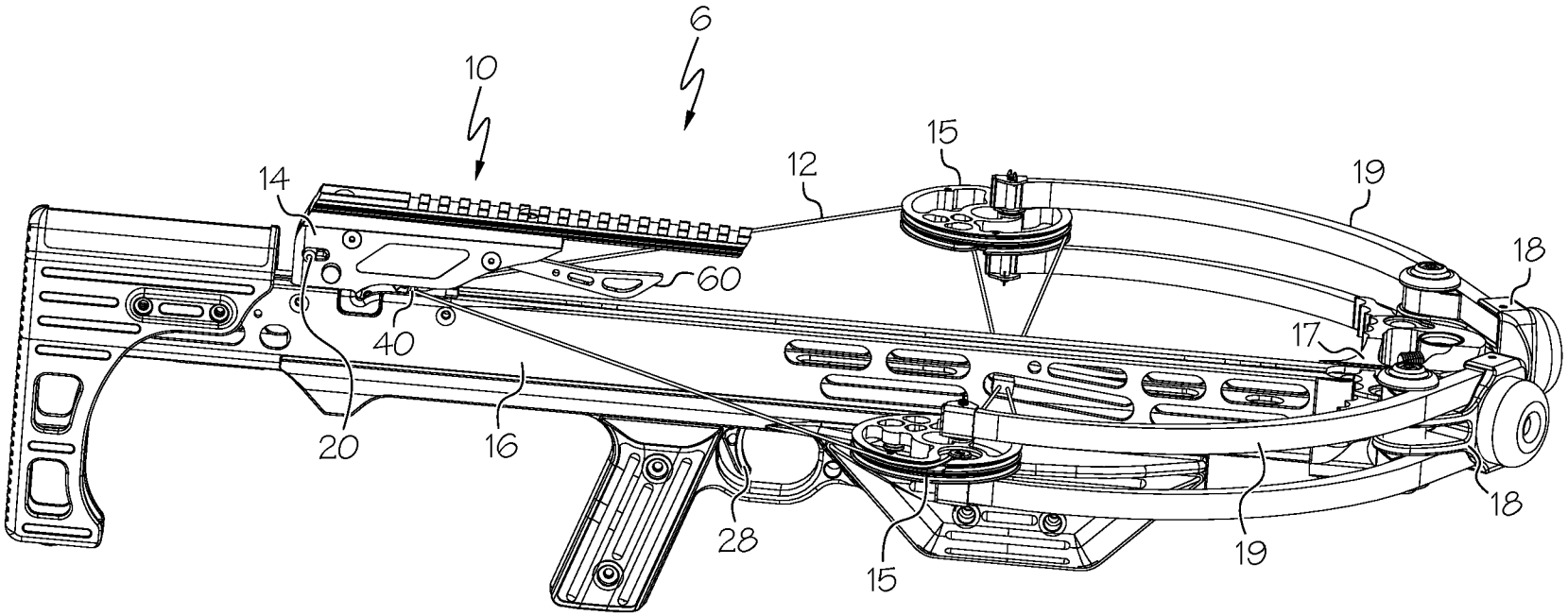
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 6 comprising a trigger assembly 10 as discussed herein. In some embodiments, a crossbow 6 comprises a stock 16, a prod 17, limb cups 18, limbs 19, rotatable members 15 and cables 13, for example as disclosed in US 2016/0138886.

Figure 2:
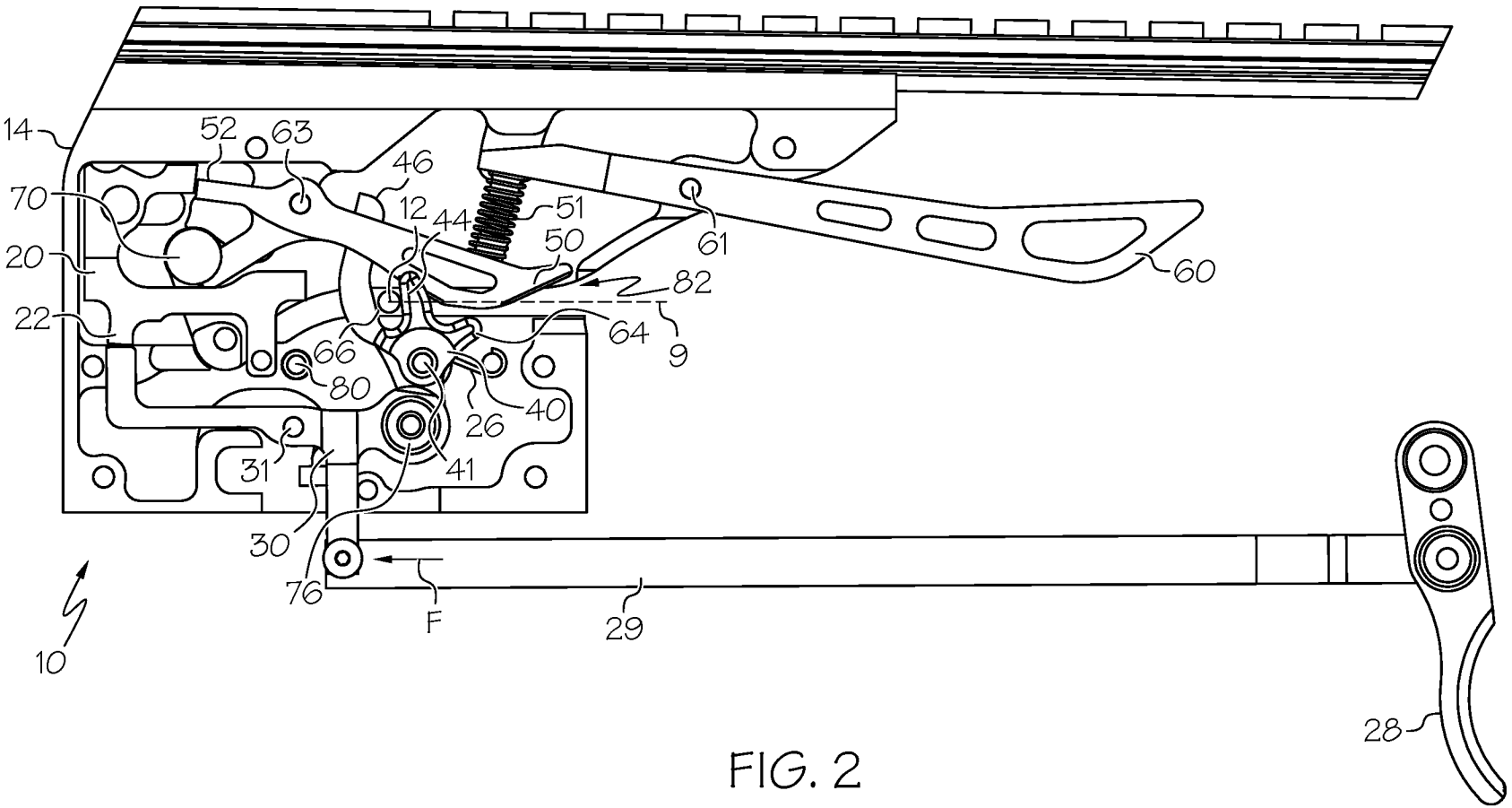
FIG. 2 shows an embodiment of a crossbow trigger assembly.
Figure 3:
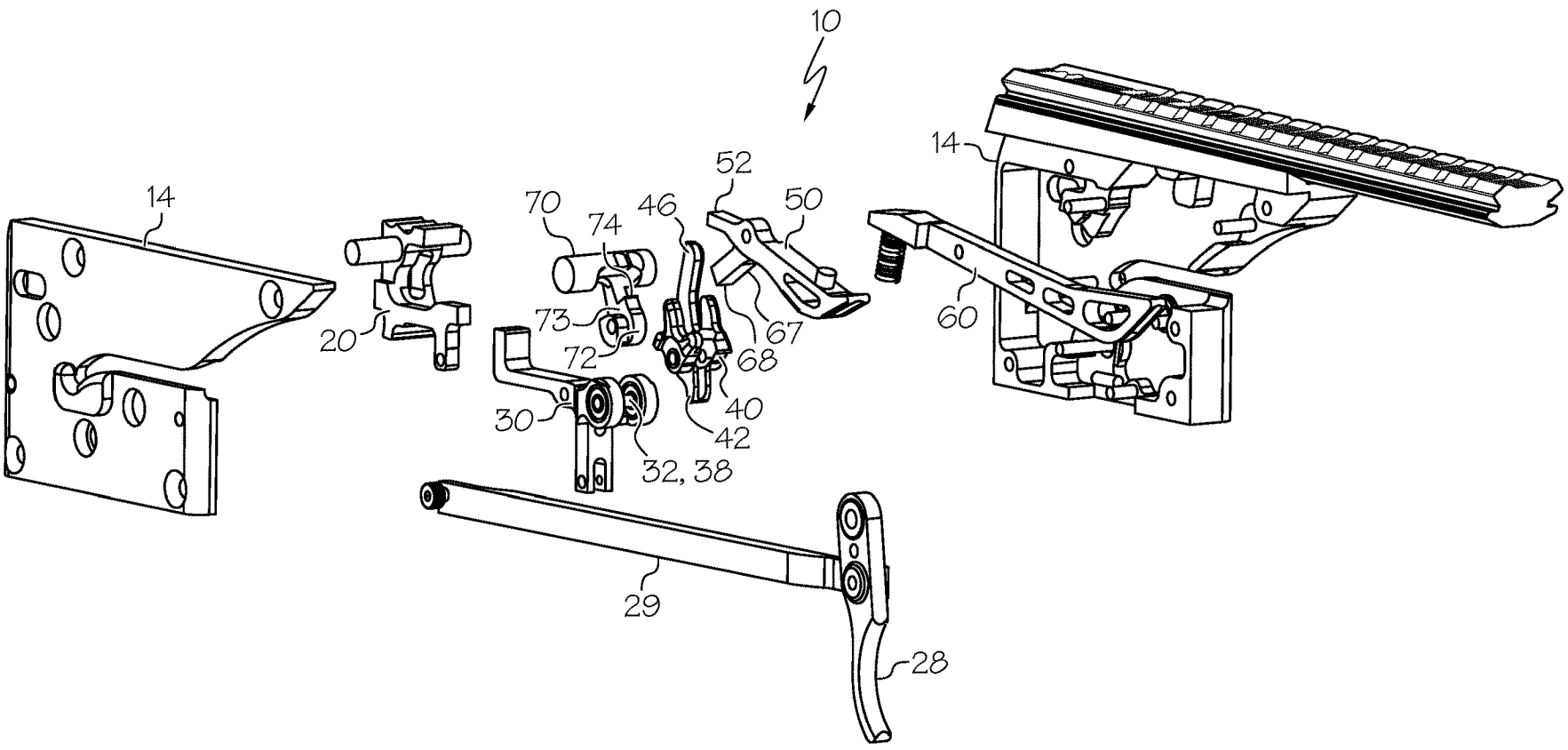
FIG. 3 an exploded view of the trigger assembly shown in FIG. 2.

FIG. 2 shows an embodiment of a crossbow trigger assembly 10. FIG. 3 shows an exploded view of the trigger assembly 10 shown in FIG. 2.

In some embodiments, a trigger assembly 10 comprises a housing 14, a trigger 30, a latch 40, a safety 20, an arrow sensor 50, an arrow retainer 60 and a disengage selector 70. In some embodiments, the trigger assembly 10 comprises a trigger lever 28 operatively engaged with the trigger 30 via linkage 29.

Figure 4:
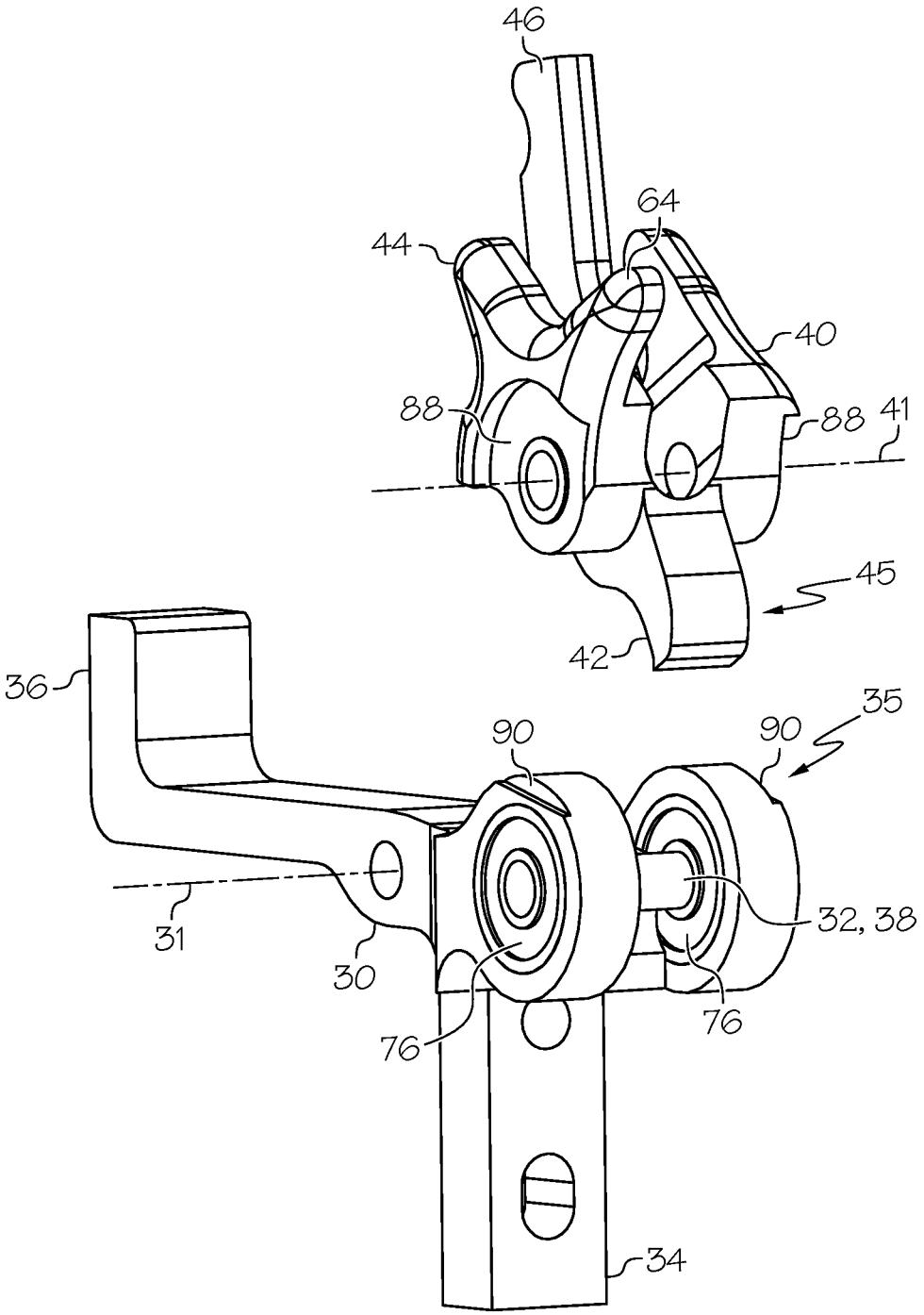
FIG. 4 shows an embodiment of a latch and an embodiment of a trigger.

Referring to FIGS. 3 and 4, desirably the trigger 30 comprises a trigger sear 32 and the latch 40 comprises a latch sear 42. The trigger sear 32 is arranged to contact the latch sear 42 in certain configurations of the trigger assembly 10. Desirably, at least one of the trigger sear 32 and latch sear 42 comprises a roller 38. As shown in FIG. 4, the trigger sear 32 comprises a roller 38 and the latch sear 42 comprises a solid surface that is fixed with respect to the rest of the latch 40.

Desirably, the trigger 30 is arranged to move between first and second positions. In some embodiments, the trigger 30 is arranged to rotate about a trigger axis 31, and the trigger 30 can rotate between the first and second positions. In some embodiments, the trigger 30 comprises a first portion 34 or first arm 34 that is arranged to be actuated by an external force. When a shooter actuates the trigger 30, the shooter applies force, directly or indirectly, to the first portion 34 of the trigger 30. In some embodiments, the trigger 30 comprises a second portion 35 that is arranged to contact the latch 40. In some embodiments the second portion 35 comprises the trigger sear 32. In some embodiments, the trigger 30 comprises a third portion 36 or third arm 36, which is constructed and arranged to contact the safety 20.

Desirably, the latch 40 is arranged to move between at least first and second positions. In some embodiments, the latch 40 is arranged to rotate about a latch axis 41, and the latch 40 can rotate between the first and second positions. In some embodiments, the latch axis 41 is oriented below an arrow shooting axis 9 defined by the crossbow. In some embodiments, the latch 40 comprises a first portion 44 that defines a string catch. Desirably, the first portion 44 of the latch 40 will hold the crossbow string in a cocked orientation when the crossbow is ready to fire. In some embodiments, the latch 40 comprises a second portion 45 that is arranged to contact the trigger 30. In some embodiments, the second portion 45 comprises the latch sear 42. In some embodiments, a latch 40 comprises a third portion 46 or third arm 46. In some embodiments, a latch 40 comprises a fourth portion 64 or fourth arm 64.

In some embodiments, the trigger sear 32 comprises a roller 38 such as a shaft or pin, which is arranged to rotate with respect to the trigger 30. In some embodiments, the roller 38 is rotatably supported by the trigger 30.

In some embodiments, a bearing 76 is used between the trigger 30 and roller 38, for example to reduce friction or rolling resistance. In various embodiments, a bearing 76 can comprise roller bearings, needle bearings, ball bearings, etc. A bearing 76 can also comprise a plain bearing, sleeve bearing or the like. In some embodiments, a bearing 76 comprises a low friction material such as PTFE or other suitable polymers, polymer composites such as PTFE with added fillers such as bronze, nylon, suitable metals, etc. In some embodiments, the trigger 30 supports a bearing 76 and the bearing 76 supports the roller 38.

In some embodiments, a trigger 30 supports a roller 38 directly, without the use of a bearing 76.

The trigger assembly 10 disclosed herein, for example wherein a sear surface comprises a roller 38 and the roller 38 is rotatably attached to a trigger 30 (or alternatively a latch 40), provides for a roller sear trigger that does not have any free floating roller parts. In some embodiments, the roller 38 is captured by the trigger 30. Further, by using a roller 38 that is supported via one or more bearings 76, the size (e.g. diameter) of the roller sear can be minimized.

Figure 5:
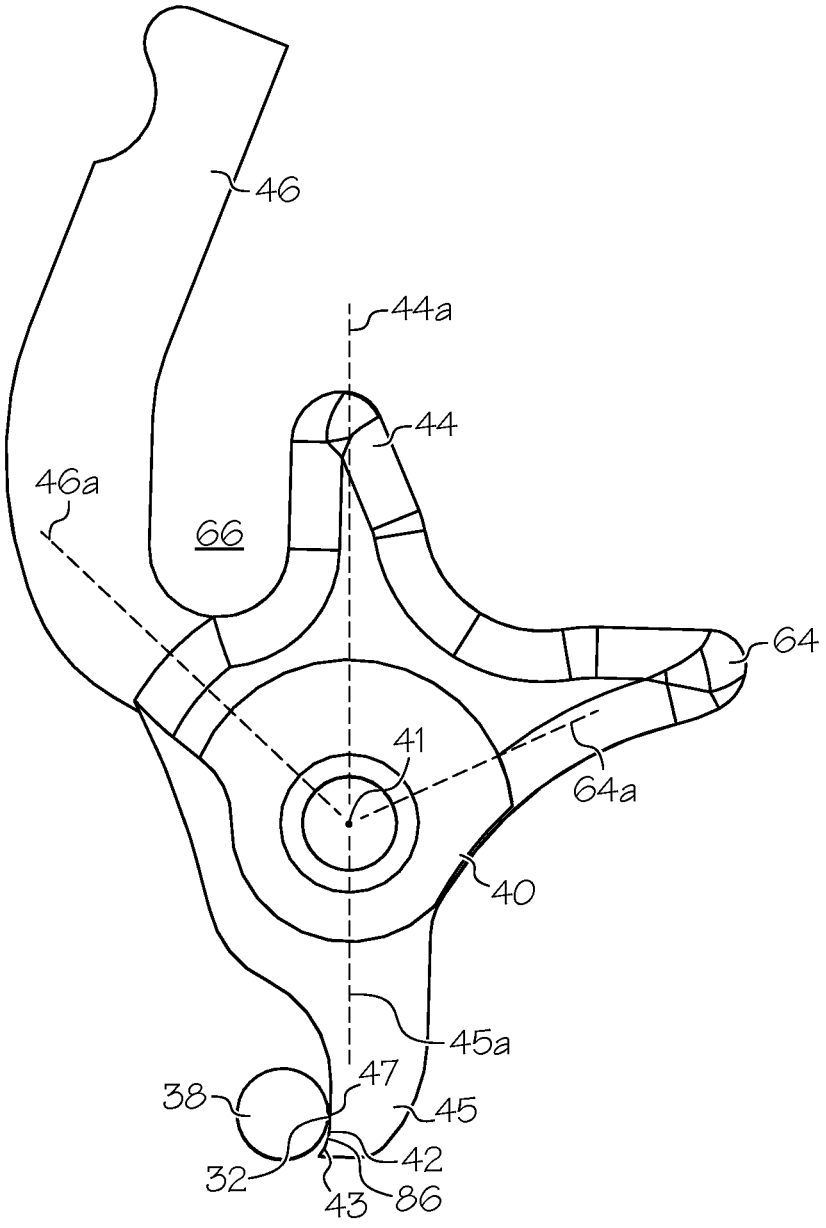
FIG. 5 shows an embodiment of a latch.

FIG. 5 shows an embodiment of a latch 40 and a roller 38 comprising a trigger sear 32. In various embodiments, the latch sear 42 can have any suitable shape. Different specific shapes in the terminal/distal portion of the latch sear 42 can influence trigger feel and trigger pull weight.

In some embodiments, the latch 40 comprises a single piece of material. In some embodiments, at least the first portion 44 and the latch sear 42 are formed from a single piece of material. In some embodiments, the third portion 46 also comprises the single piece of material. In some embodiments, the fourth portion 64 also comprises the single piece of material.

In some embodiments, the first portion 44 comprises a catch portion 44 suitable for retaining the bowstring in a cocked configuration. In some embodiments, the first portion 44 extends outward in a first radial direction 44*a*. In some embodiments, the second portion 45 comprises a sear portion 45, which extends in a second radial direction 45*a*. In some embodiments, the first radial direction 44*a* is substantially opposite the second radial direction 45*a*.

In some embodiments, the third portion 46 comprises a disengage portion 46, which extends in a third radial direction 46*a*. In some embodiments, the latch 40 defines a cavity 66 located between the first portion 44 and the third portion 46. In some embodiments, the third portion 46 comprises curvature along its length. In some embodiments, the fourth portion 64 comprises a reset portion 64, which extends in a fourth radial direction 64*a*. In some embodiments, the first portion 44 is located between the third portion 46 and the fourth portion 64.

In some embodiments, the third portion 46 comprises a cantilever arm structure that extends outwardly from the latch 40 in a radial direction. In some embodiments, the fourth portion 64 comprises a cantilever arm structure that extends outwardly from the latch 40 in a radial direction.

Referring again to FIG. 2, the trigger assembly 10 is shown with the bowstring 12 in a drawn orientation and being retained in position by the latch 40. The trigger housing 14 defines a slot 82 that includes the shooting axis 9. The latch 40 is shown in a first position. The catch portion 44 of the latch 40 is positioned in the slot 82. The catch portion 44 contacts the bowstring 12, while the latch sear 42 contacts the trigger sear 32 (see e.g. FIG. 4).

In some embodiments, an arrow retainer 60 is provided, for example to hold an arrow in position on the crossbow. In some embodiments, the arrow retainer 60 comprises a solid body that is supported by the housing 14 and arranged to move with respect to the housing 14. In some embodiments, the arrow retainer 60 pivots with respect to the housing 14 about a retainer axis 61. A biasing member 51 such as a spring can bias the arrow retainer 60 into its ordinary at-rest position. In some embodiments, the biasing member 51 contacts the housing. In some embodiments, the biasing member 51 contacts another moving component of the trigger mechanism, such as the arrow sensor 50.

In some embodiments, the arrow sensor 50 is arranged to move with respect to the housing 14 between first and second positions. In some embodiments, the arrow sensor 50 is arranged to pivot with respect to the housing 14 about a sensor axis 63. A biasing member 51 such as a spring can bias the arrow sensor 50 to the first position as shown in FIG. 2. In some embodiments, a biasing member 51 contacts the housing 14.

In some embodiments, the biasing member 51 contacts the arrow sensor 50 and also contacts the arrow retainer 60. In some embodiments, the biasing member 51 simultaneously biases the arrow sensor 50 and the arrow retainer 60 to their respective first positions. In some embodiments, the arrow retainer 60 comprises an engagement feature, such as a protrusion, arranged to engage the biasing member 51. In some embodiments, the arrow sensor 50 comprises an engagement feature, such as a protrusion, arranged to engage the biasing member 51.

The arrow sensor 50 desirably comprises a safety contacting portion 52. When the arrow sensor 50 is in the first position (e.g. no arrow present), the safety contacting portion 52 is oriented to prevent operation of the safety 20, for example by contacting the safety 20 and preventing movement of the safety 20.

Desirably, the safety 20 is arranged to move with respect to the housing 14 between first and second positions. In some embodiments, the safety 20 is arranged to slide with respect to the housing 14. Desirably, the safety 20 comprises a trigger contacting portion 22. When the safety 20 is in the first position (e.g. a safe/no-fire position) as shown in FIG. 2, the trigger contacting portion 22 is oriented to prevent operation of the trigger 30, for example by contacting the trigger 30 to prevent movement of the trigger 30.

Figure 6:
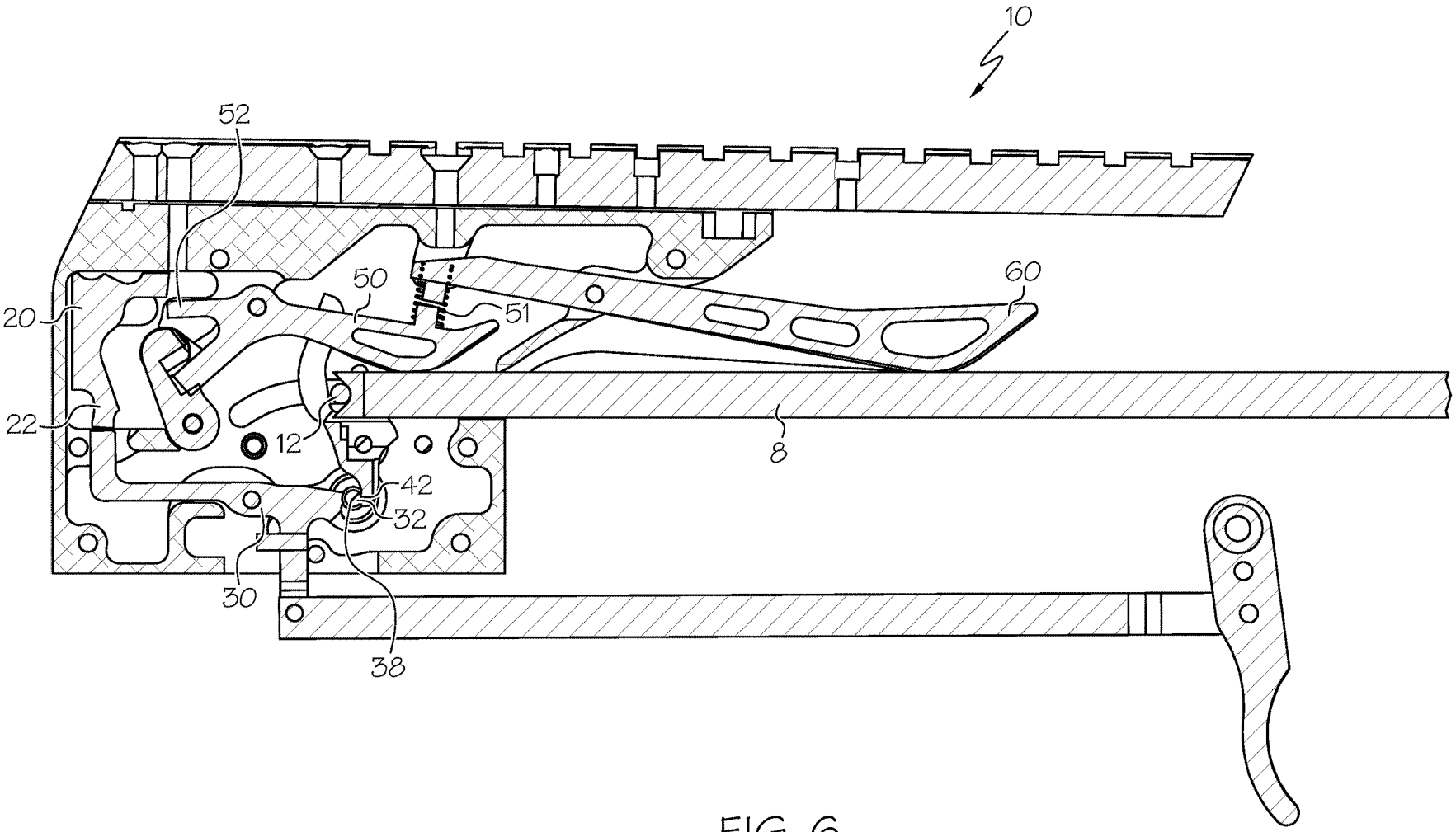
FIG. 6 shows a sectional view of an embodiment of a crossbow trigger assembly.

FIG. 6 shows a cross-sectional view of an embodiment of a trigger assembly 10. An arrow 8 is shown loaded into the trigger assembly 10. The presence of the arrow 8 moves the arrow sensor 50 into its second position, and the safety contacting portion 52 has moved and will not interfere with operation of the safety 20.

FIG. 6 shows the roller 38 that comprises the trigger sear 32 in contact with the latch sear 42. The trigger 30 is in its first position.

Figure 7:
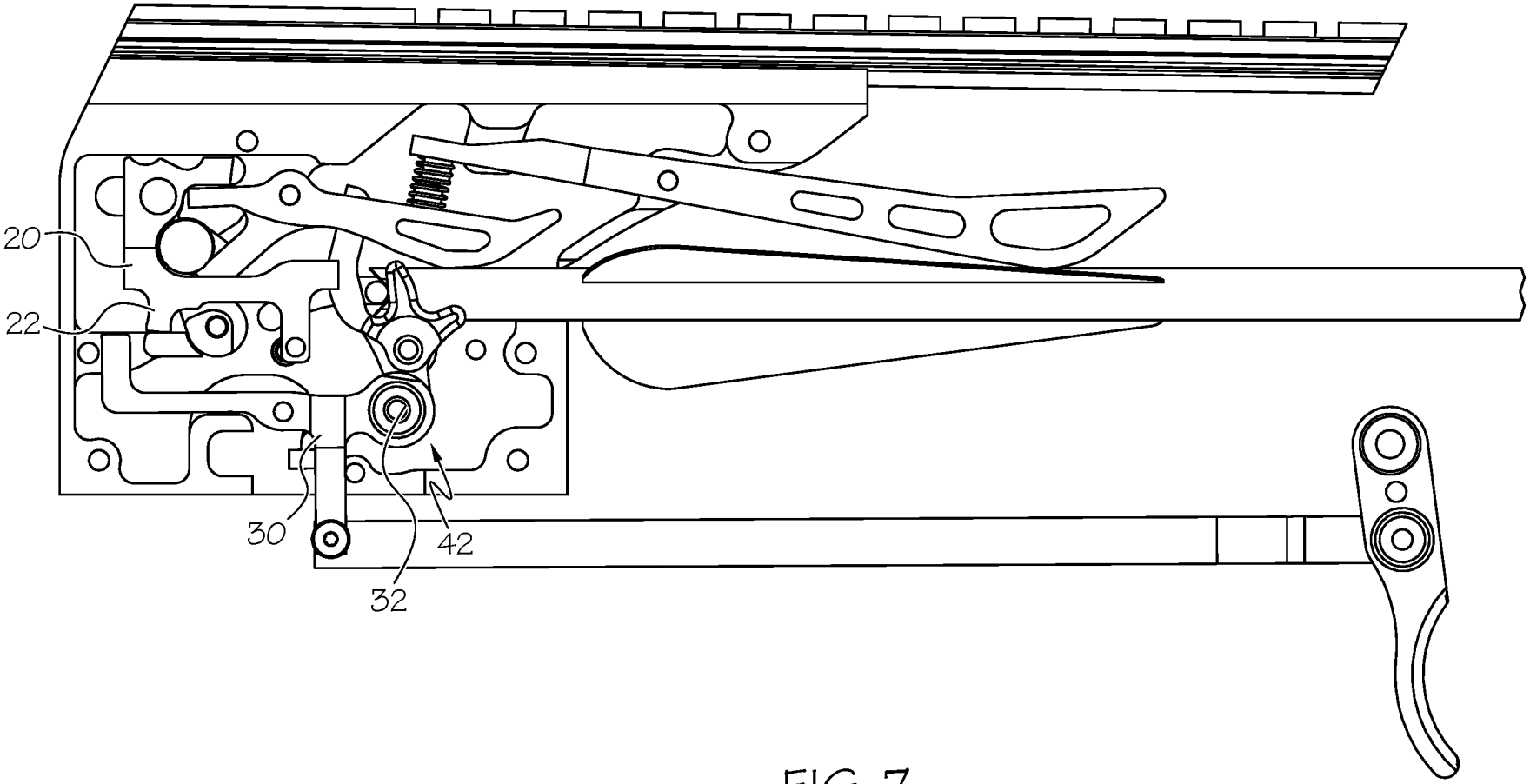
FIG. 7 shows an embodiment of a crossbow trigger assembly in a ready to fire orientation.

FIG. 7 shows an embodiment of a trigger assembly 10 in a ready-to-fire orientation. The safety 20 has been moved into its second position, and the trigger contacting portion 22 is no longer positioned to interfere with the trigger 30. Thus, the trigger 30 can be actuated, wherein the trigger sear 32 will clear the latch sear 42, allowing the arrow 8 to launch.

Figure 8:
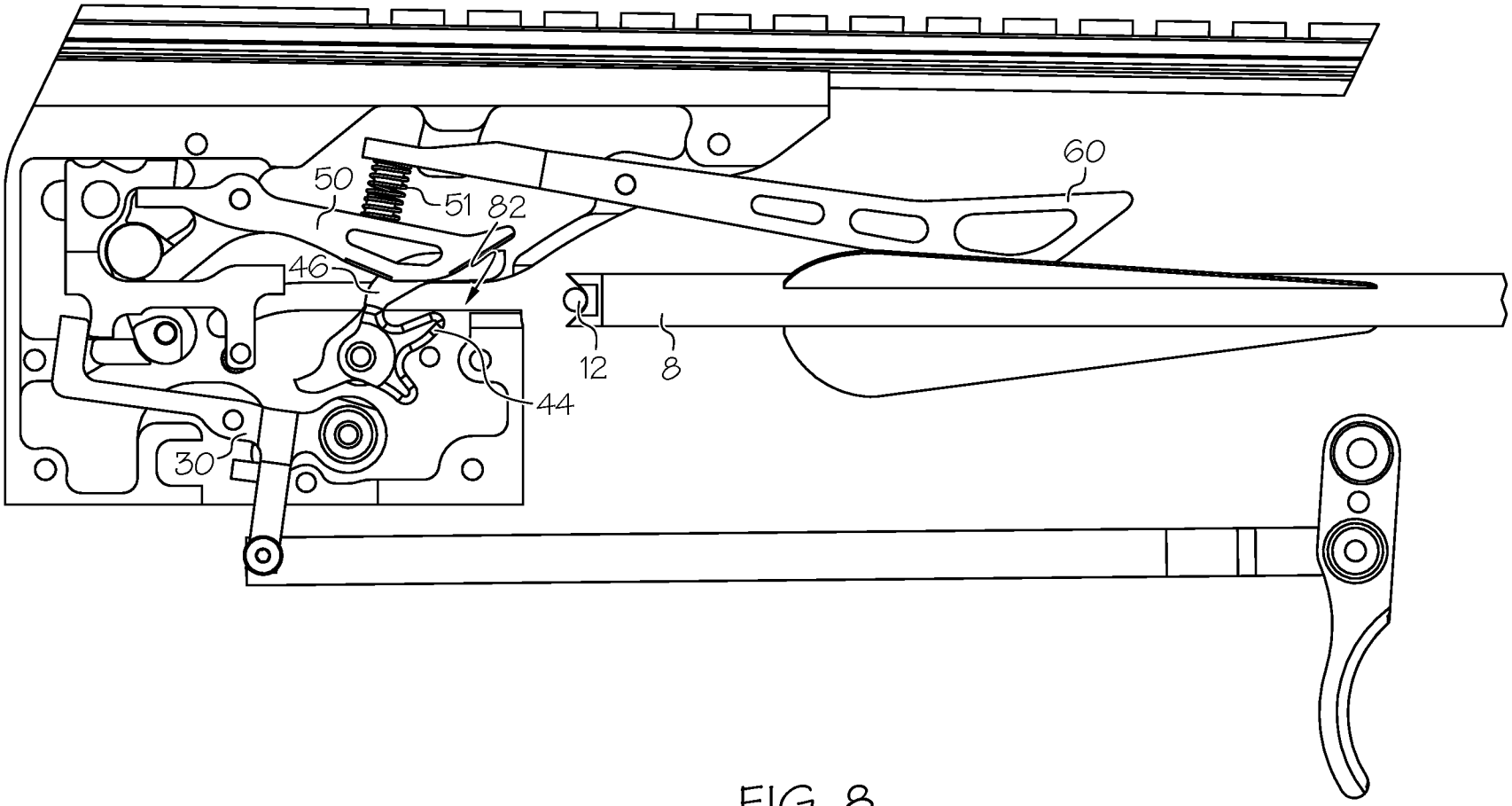
FIG. 8 shows an embodiment of a crossbow trigger assembly shortly after firing.

FIG. 8 shows an embodiment of the trigger assembly 10 after the trigger 30 has been operated and moved to its second position. The trigger sear 32 has cleared the latch sear 42, allowing the latch 40 to pivot forward, releasing the bowstring 12.

The arrow 8 is shown in a position where it has cleared the arrow sensor 50 but it has not yet cleared the arrow retainer 60. In the arrangement shown where the biasing member 51 applies force to both the arrow sensor 50 and arrow retainer 60, the amount of force applied to the arrow 8 by the arrow retainer 60 is reduced when the arrow 8 clears the arrow sensor 50.

In some embodiments, the latch 40 is moveable to a second position during a decocking operation, as discussed below.

FIG. 8 shows the latch 40 in a third position, wherein the catch portion 44 is not positioned in the slot 82. In some embodiments, the latch 40 is moved in a first direction, such as a first rotational direction, from the first position to reach the third position. In some embodiments, the third position of the latch 40 can be considered rotated forward from the first position of the latch 40.

In some embodiments, when the latch 40 is in the third position, the third portion 46 of the latch is located in the slot 82.

Referring again to FIG. 2, in some embodiments, a trigger assembly 10 is constructed and arranged to allow decocking of the crossbow from a cocked orientation without operation of the trigger 30. For example, when the crossbow is cocked with the bowstring 12 being retained by the catch portion 44, the disengaging features of the trigger assembly 10 allow the bowstring 12 to be released from the latch 40 and let down without operating the trigger 30.

In some embodiments, the latch 40 comprises a third portion 46 or disengage portion 46. In some embodiments, the disengage portion 46 comprises a cantilever arm that extends from the latch 40 from a different location, or in a different direction, than the catch portion 44. In some embodiments, the latch 40 defines a cavity 66 between the disengage portion 46 and the catch portion 44, and the bowstring 12 is oriented in the cavity 66 when the crossbow is cocked. In some embodiments, when the crossbow is cocked, the catch portion 44 is located in front of the bowstring 12 and the disengage portion 46 is located behind the bowstring 12 in the slot 82.

In some embodiments, the trigger assembly 10 comprises a latch retaining mechanism 80 arranged to retain the latch 40 in a particular orientation, for example in a second position or disengage orientation. In some embodiments, a latch retaining mechanism 80 comprises a detent. In some embodiments, a latch retaining mechanism 80 comprises a spring pin or spring ball that is supported by the housing 14 and arranged to engage the latch 40. In some embodiments, a latch retaining mechanism 80 is arranged to engage the disengage portion 46 of the latch 40. In some embodiments, the latch 40 comprises a cavity or recess arranged to receive the latch retaining mechanism 80.

In some embodiments, the latch 40 comprises a third portion or reset portion 64. In some embodiments, the reset portion 64 comprises a cantilever arm that extends from the latch 40 from a different location, or in a different direction, than the catch portion 44 and the disengage portion 46. In some embodiments, the catch portion 44 is located between the disengage portion 46 and the reset portion 64. Desirably, the reset portion 64 can be used to release the latch 40 from the latch retaining mechanism 80.

Desirably, the disengage selector 70 is arranged to move between first and second positions. During normal crossbow use, the disengage selector remains in its first position. Desirably, switching the disengage selector 70 to its second position places the trigger assembly 10 into a decocking mode. In some embodiments, the disengage selector 70 moves along a linear path between its first and second positions. In some embodiments, movement of the disengage selector 70 is lateral to the shooting axis 9.

Referring to FIG. 3, in some embodiments, the disengage selector 70 comprises a latch interfering portion 72 arranged to interfere with movement of the latch 40. Desirably, the latch interfering portion 72 is arranged to prevent the latch 40 from reaching the second/disengage position and preventing the latch 40 from engaging the latch retaining mechanism 80 when the disengage selector 70 is in the first position. When the disengage selector 70 is in its second (e.g. decock) orientation, the latch interfering portion 72 does not prevent the latch 40 from reaching the second position.

In some embodiments, the disengage selector 70 cannot be moved to its second (e.g. decock) orientation unless the arrow sensor 50 is in its first position (e.g. no arrow present). In some embodiments, the arrow sensor 50 comprises a first disengage contacting portion 67 and the disengage selector 70 comprises a first sensor contacting portion 73. Desirably, when the arrow sensor 50 is in the second position (e.g. arrow present), the disengage selector cannot be moved into its second position and the trigger assembly 10 cannot enter the decocking mode.

In some embodiments, the disengage selector 70 cannot be moved to its second (e.g. decock) orientation unless the safety 20 is in its first position (e.g. safe/no fire mode). In the embodiment of FIGS. 2 and 3, the safety 20 can only move to the second position (e.g. fire mode) when the arrow sensor 50 is in the second position (e.g. arrow present). As long as the arrow sensor 50 is in the second position, the disengage selector 70 cannot be moved to its second (e.g. decock) orientation.

In some embodiments, an arrow cannot be inserted while the disengage selector 70 is in the second (e.g. decock) orientation. In some embodiments, the arrow sensor 50 comprises a second disengage contacting portion 68 and the disengage selector 70 comprise a second sensor contacting portion 74. In some embodiments, when the disengage selector 70 is in the second (e.g. decock) orientation, the second sensor contacting portion 74 is positioned to interfere with movement of the arrow sensor 50 and the arrow sensor 50 cannot move to its second position.

FIG. 2 shows the trigger assembly 10 in a cocked orientation, with the latch 40 in its first position. In some embodiments, the latch 40 is biased to return to the first position when no other external loading is present, for example by a spring 26. In some embodiments, the spring 26 is arranged to bias the latch 40 to return to the first position whether the latch 40 has been moved in a first direction or a second direction (e.g. forward or backward, clockwise or counterclockwise, etc.). In some embodiments, the latch 40 is oriented in the first position when the crossbow is cocked and the latch 40 is loaded with forces applied by the bowstring 12 and trigger 30.

FIGS. 9-12 show embodiments of a trigger assembly 10 during a decocking operation. From the cocked orientation of the crossbow as shown in FIG. 2, the disengage selector 70 can be moved to its second orientation, placing the trigger assembly 10 into a decocking mode. In some embodiments, a detent system 79 can be provided to encourage the disengage selector 70 a given position. The bowstring 12 can then be moved rearward in the trigger assembly, away from the main catch 44, for example by way of an external applied force. The bowstring 12 can be moved using any suitable method, for example by the archer directly or by using a cocking aid such as a cocking rope or a cocking crank. The application of force to the bowstring 12 during the decocking operation can be similar to that of a standard cocking operation. As the bowstring 12 moves away from the catch 44, it contacts the third portion/disengage arm 46 of the latch 40 and moves the latch 40 out of its first position.

Desirably, the latch 40 will move to a second position as shown in FIGS. 9-12, wherein the latch 40 is engaged with the latch retaining mechanism 80. Desirably, the latch retaining mechanism 80 will retain the latch 40 in the second position after force from the bowstring 12 is no longer applied to the latch 40. Thus, the latch retaining mechanism 80 will prevent force from the spring 26 from returning the latch 40 to its first (e.g. at rest) position.

Desirably, when the latch 40 is in the second position, the catch 44 portion does not overlap the shooting axis 9 or the slot 82 in the trigger assembly that receives the bowstring 12. Desirably, when the latch 40 is in the second position, the catch 44 will not contact the bowstring 12 as the bowstring is let down. Thus, the bowstring 12 can move past the catch 44 and exit the trigger assembly, and the crossbow can be decocked without operating the trigger 30.

In some embodiments, the latch retaining mechanism 80 comprises a first portion 80*a* and a second portion 80*b*. As shown in the Figures, the first portion 80*a* and second portion 80*b* each comprise a detent. In some embodiments, the first portion 80*a* and the second portion 80*b* engage the latch 40 from opposite sides.

In some embodiments, the latch 40 comprises a reset portion 64. Desirably, when the latch 40 is in the second position, the reset portion 64 is arranged to reset the latch 40 as the bowstring 12 is lowered. In some embodiments, the reset portion 64 overlaps the shooting axis 9 or the slot 82 in the trigger assembly that receives the bowstring 12 when the latch 40 is in the second position. In some embodiments, as the bowstring 12 is lowered, it will contact the reset portion 64 and disengage the latch from the latch retaining mechanism 80. This resets the latch 40 to a normal operation mode.

Figure 9:
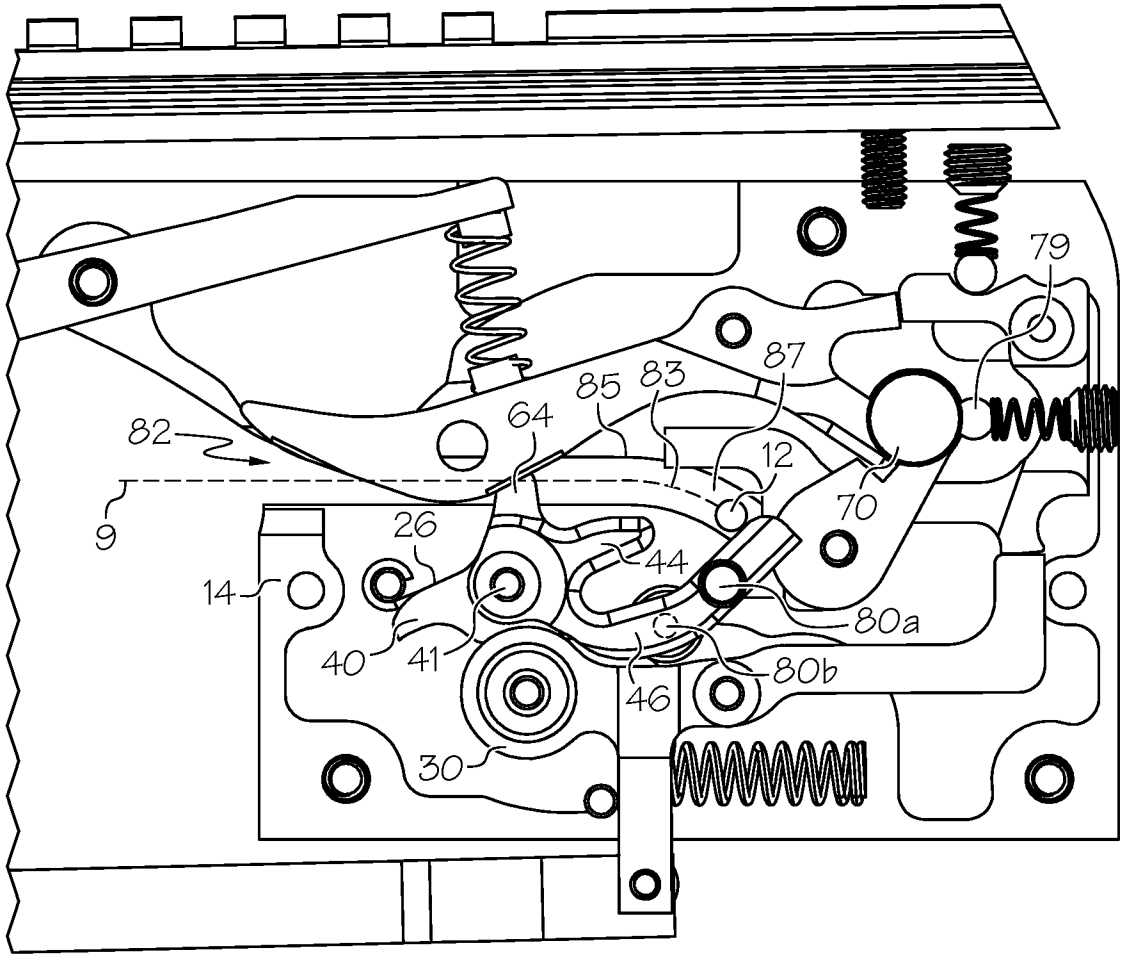
FIGS. 9-12 show embodiments of a trigger assembly during a decocking operation.
Figure 10:
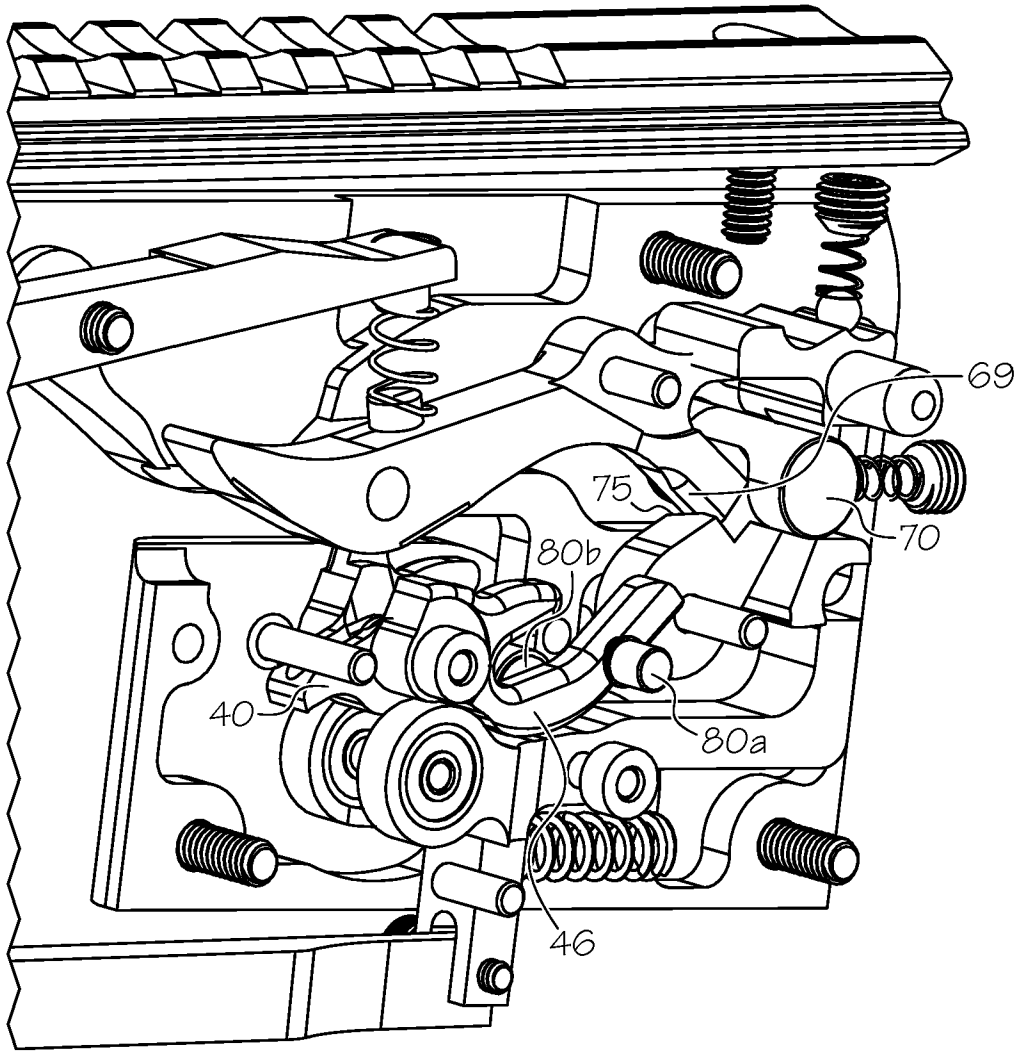
Figure 11:
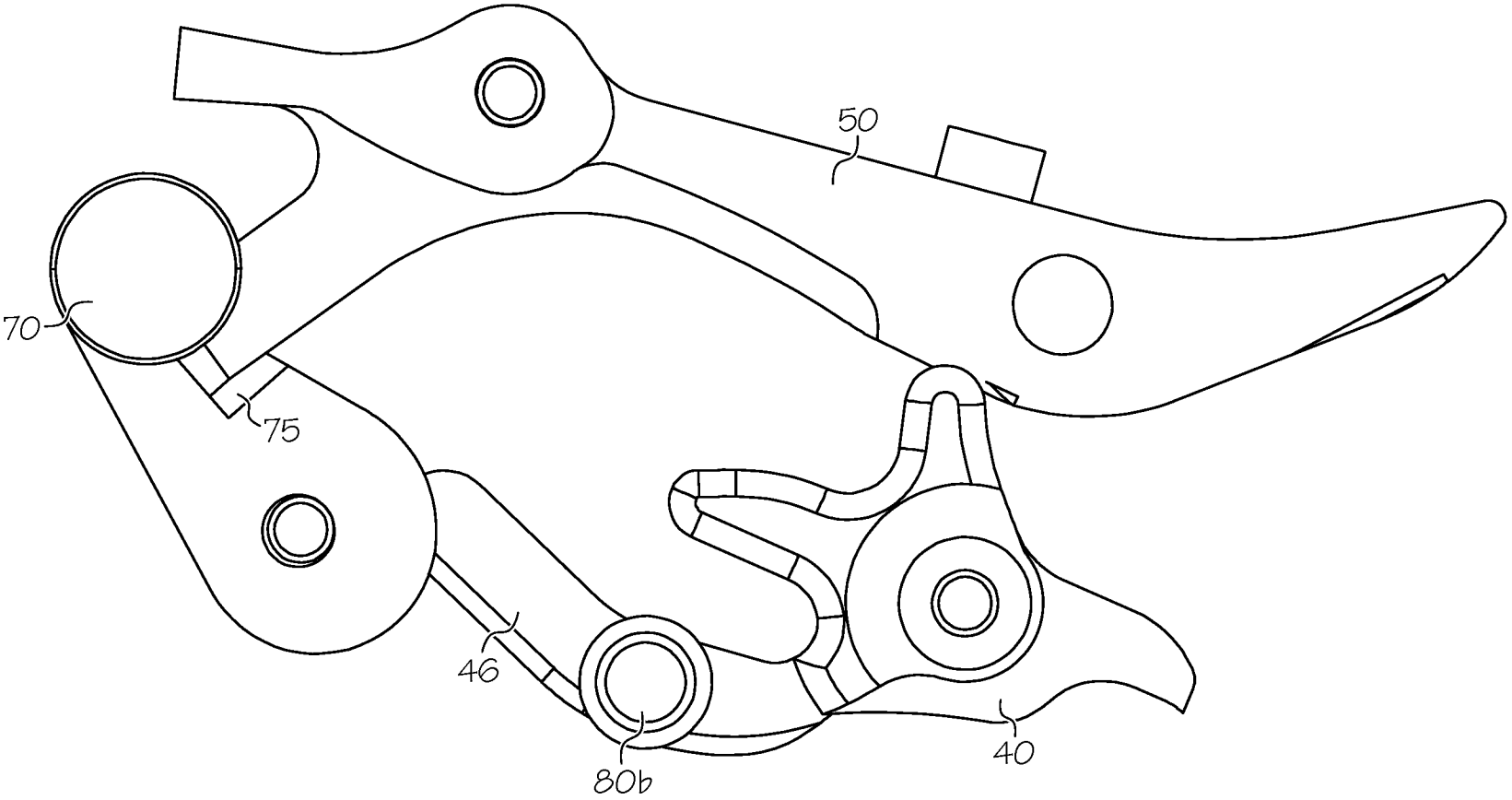
Figure 12:
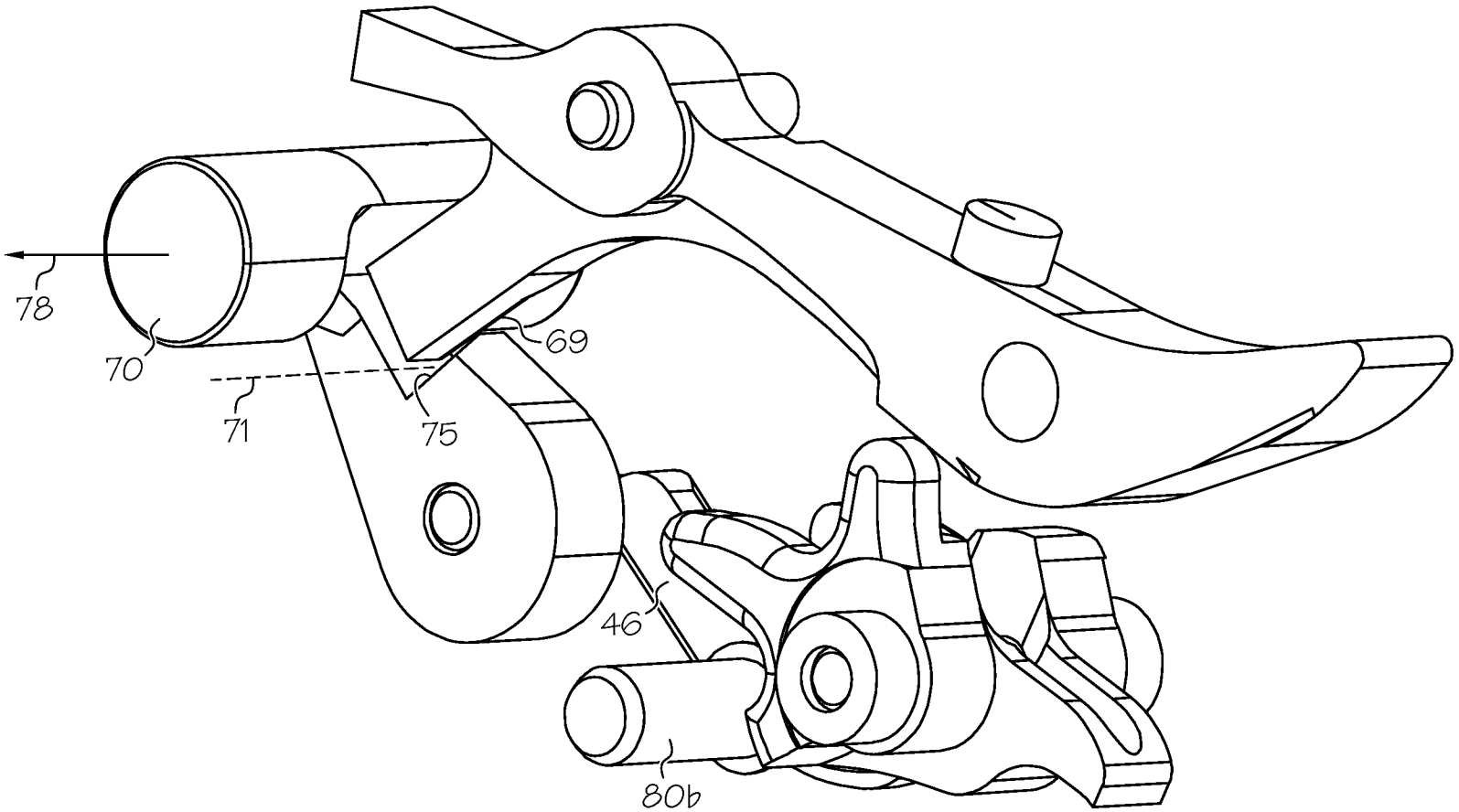
Figure 13:
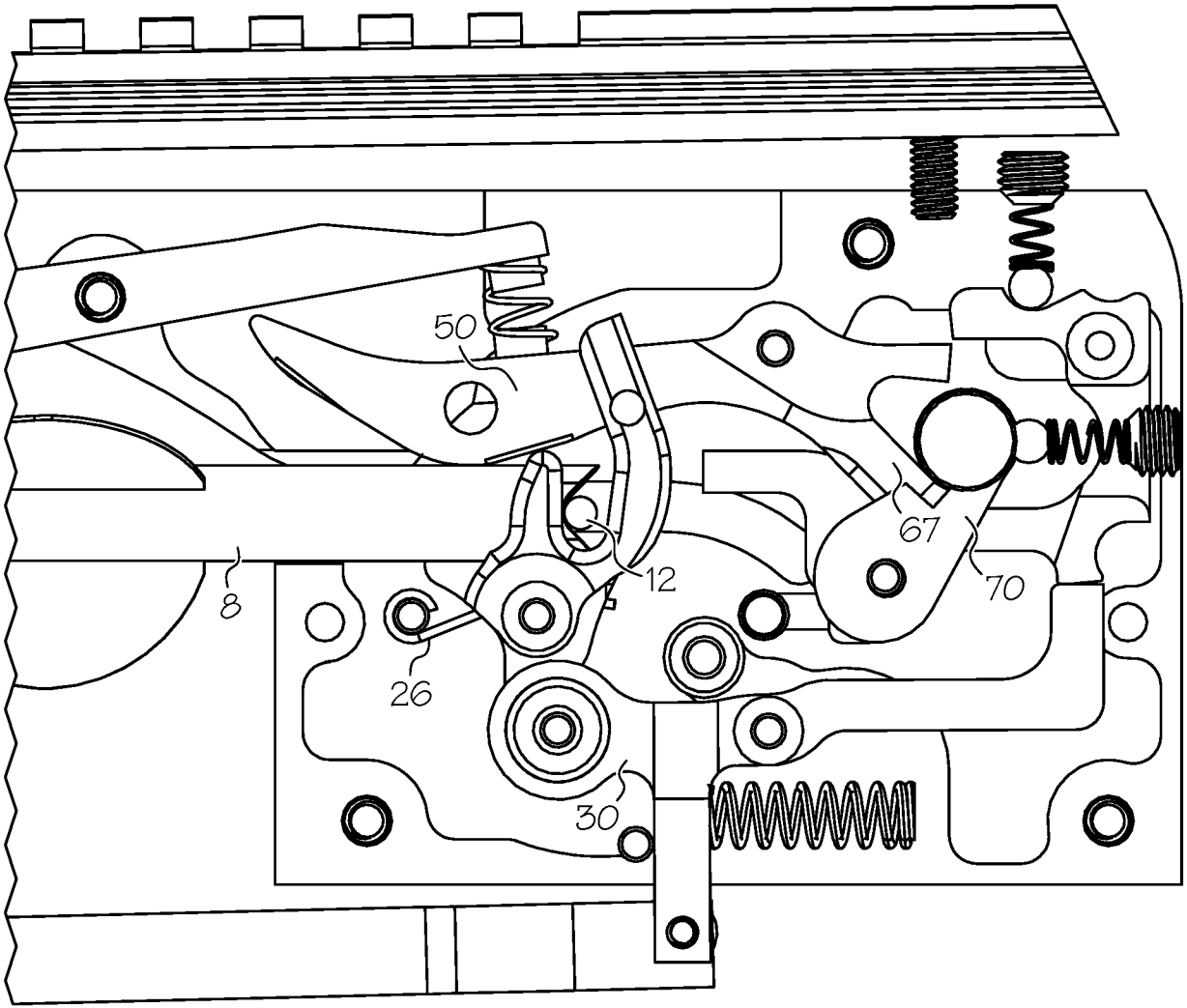
FIGS. 13-16 show embodiments of a trigger assembly when the arrow sensor is in a second position.
Figure 14:
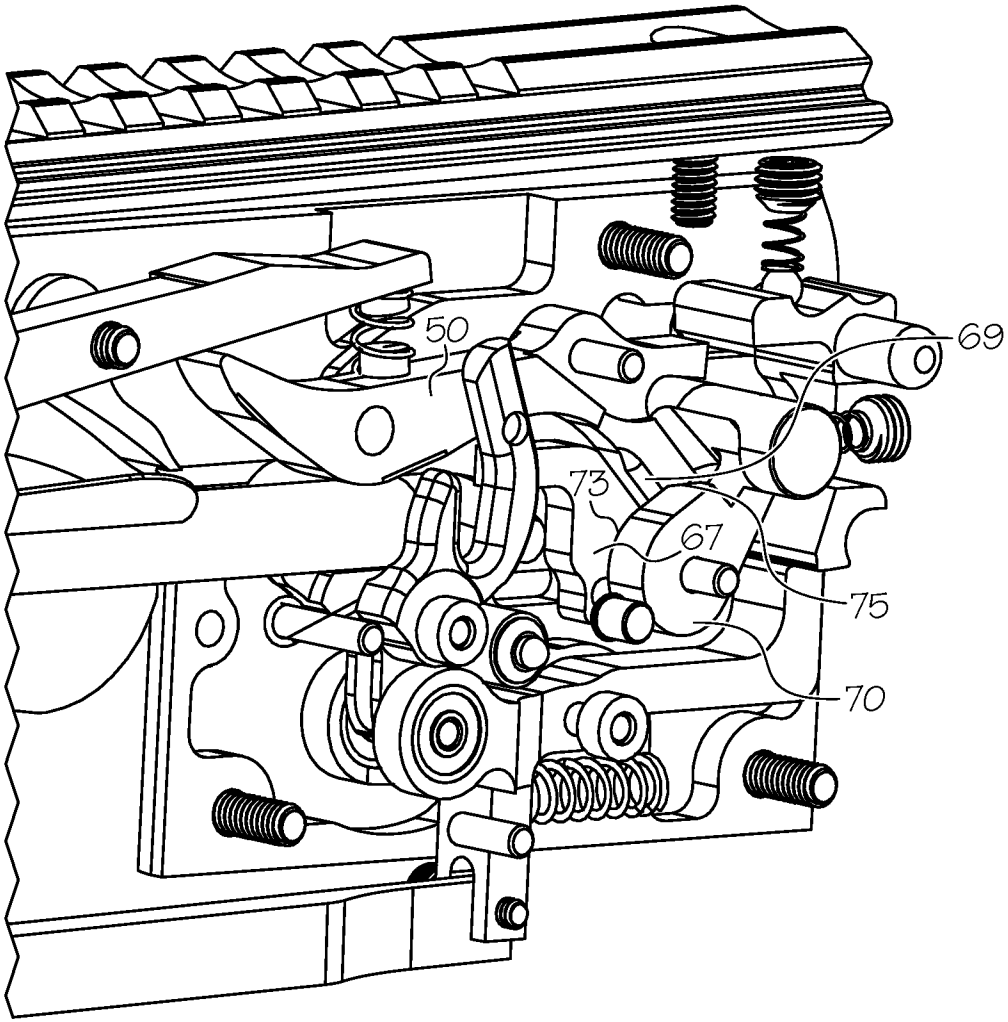
Figure 15:
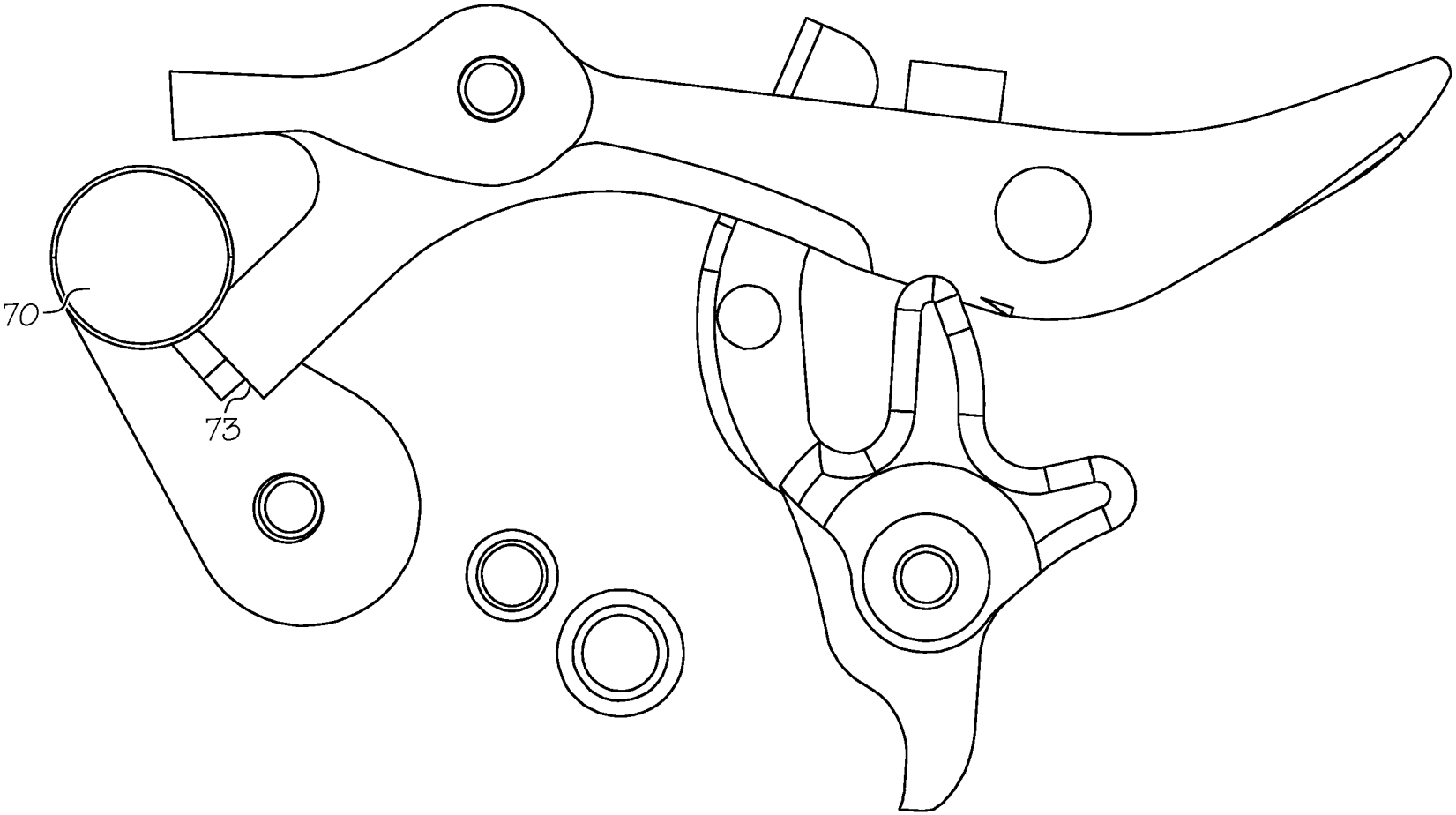

Referring to FIG. 9, in some embodiments, the trigger assembly 10 defines a slot 82 that is open to a front side of the trigger assembly 10. The slot 82 can receive the arrow and the bowstring 12. In some embodiments, at least a portion of the slot 82 is defined by the housing 14. For example, in some embodiments, a first side of the housing 14 defines a first slot portion 85 and a second side of the housing defines a second slot portion (not illustrated in FIG. 9). Surfaces of the housing 14 that define the slot portion(s) 85 can act as string guides that position the bowstring 12 when the bowstring 12 is in the slot 82. At least a portion of the shooting axis 9 is oriented in the slot 82.

In some embodiments, the slot 82 comprises a first portion 85 and a second portion 87, wherein the second portion 87 extends non-parallel to the first portion 85. In some embodiments, the first portion 85 is straight along its length and extends parallel to, or coaxial with, the shooting axis 9 of the crossbow. In some embodiments, the second portion 87 extends non-parallel to the shooting axis 9. In some embodiments, the second portion 87 is straight along its length and oriented at an angle to the first portion 85. In some embodiments, second portion 87 comprises multiple straight portions oriented at an angle to one another. In some embodiments, the second portion 87 comprises curvature.

In some embodiments, the slot 82 comprises curvature. In some embodiments, the slot 82 comprises a constant height (e.g. distance between surfaces of the housing 14 that define the slot 82) and a central axis 83 of the slot portion 85 comprises curvature. In some embodiments, the curvature of the slot 82 is concave with respect to the latch axis 41.

In some embodiments, at least a portion of the disengage portion 46 of the latch 40 is oriented in the slot 82 as the latch 40 transitions from a cocked orientation to being engaged with the latch retaining mechanism 80 as shown in FIG. 9. In some embodiments, the disengage portion 46 traverses the curved portion 87 of the slot 82.

In some embodiments, the slot 82 comprises a first portion and a second portion, wherein the first portion is non-parallel to the second portion. In some embodiments, the latch axis 41 is offset from the shooting axis 9 in a particular direction (e.g. below), and the second portion of the slot extends away from the shooting axis 9 in a similar direction (e.g. downward).

Figure 16:
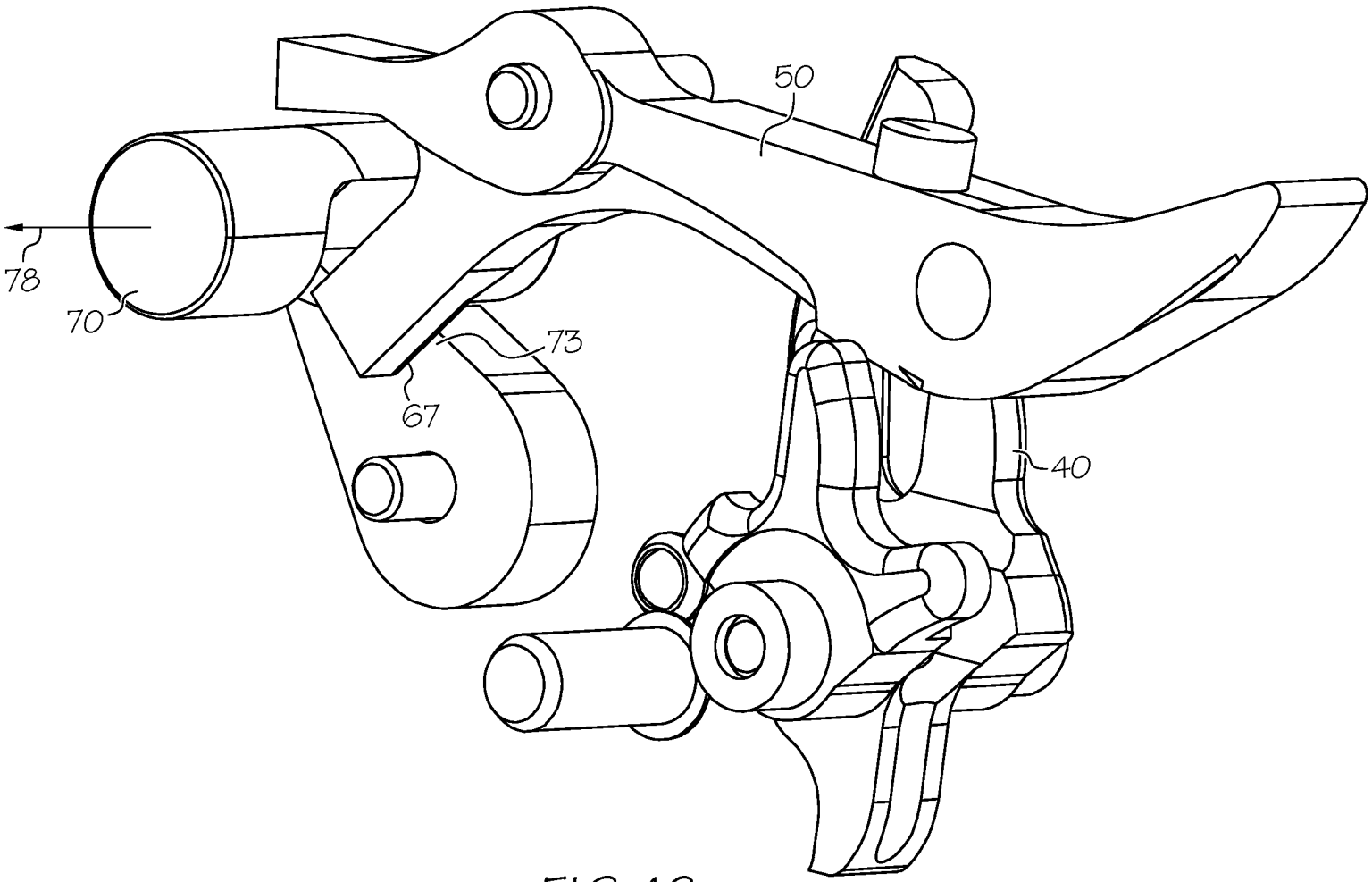

FIGS. 13-16 show embodiments of a trigger assembly 10 when the arrow sensor 50 is in the second position (e.g. arrow present), which in some embodiments can prevent the disengage selector 70 from entering the decocking mode. In some embodiments, when the arrow sensor 50 is in the second position, the arrow sensor 50 interferes with operation of the disengage selector 70. In some embodiments, a first disengage contacting portion 67 of the arrow sensor 50 will abut a first sensor contacting portion 73 of the disengage selector 70. As best shown in FIG. 16, interference between the arrow sensor 50 and the disengage selector 70 prevents the disengage selector 70 from moving in the direction of arrow 78 to its second (e.g. decock) orientation.

Figure 17:
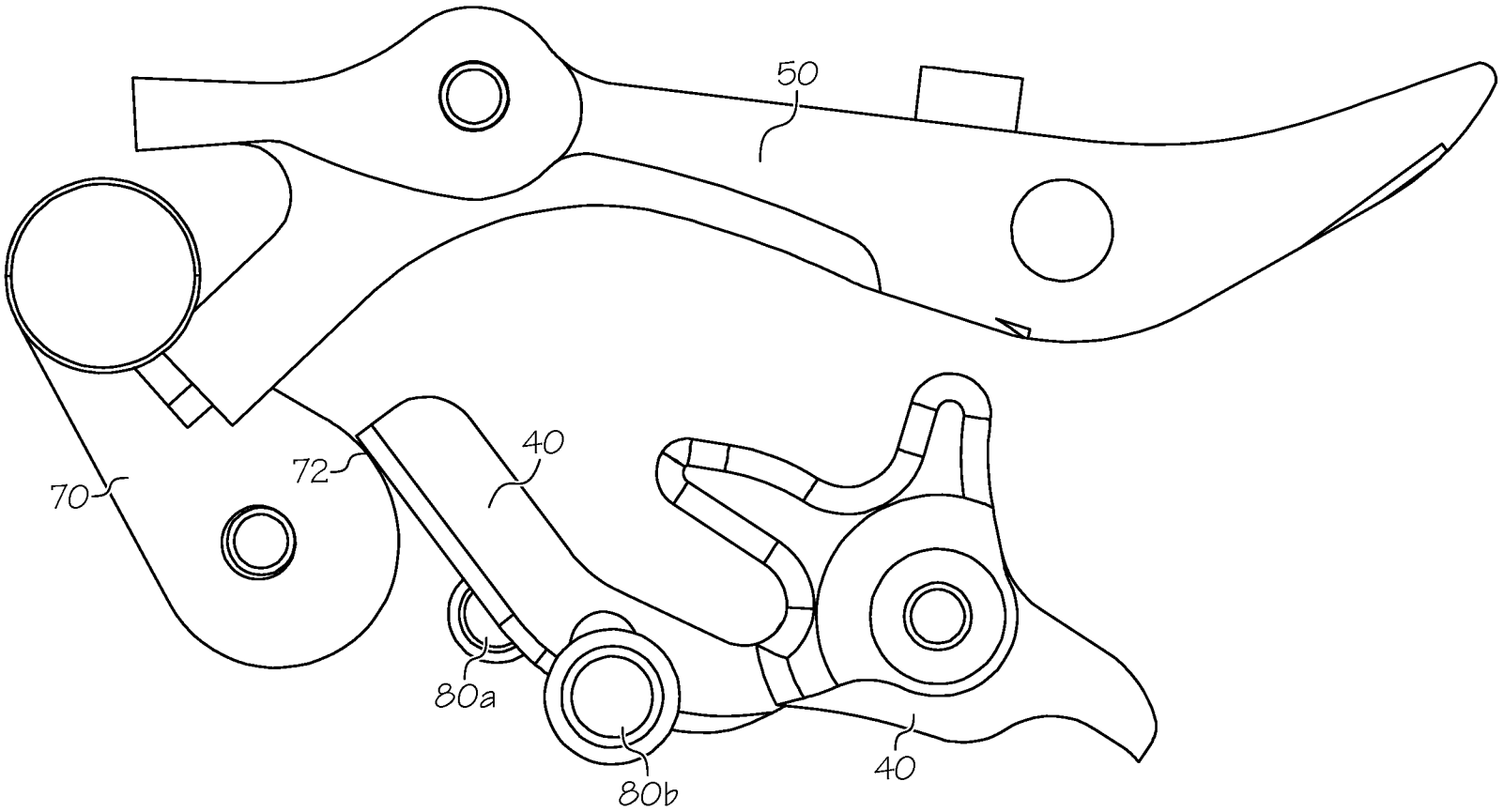
FIGS. 17-19 show embodiments of a trigger assembly when the disengage selector is in the first orientation.
Figure 18:
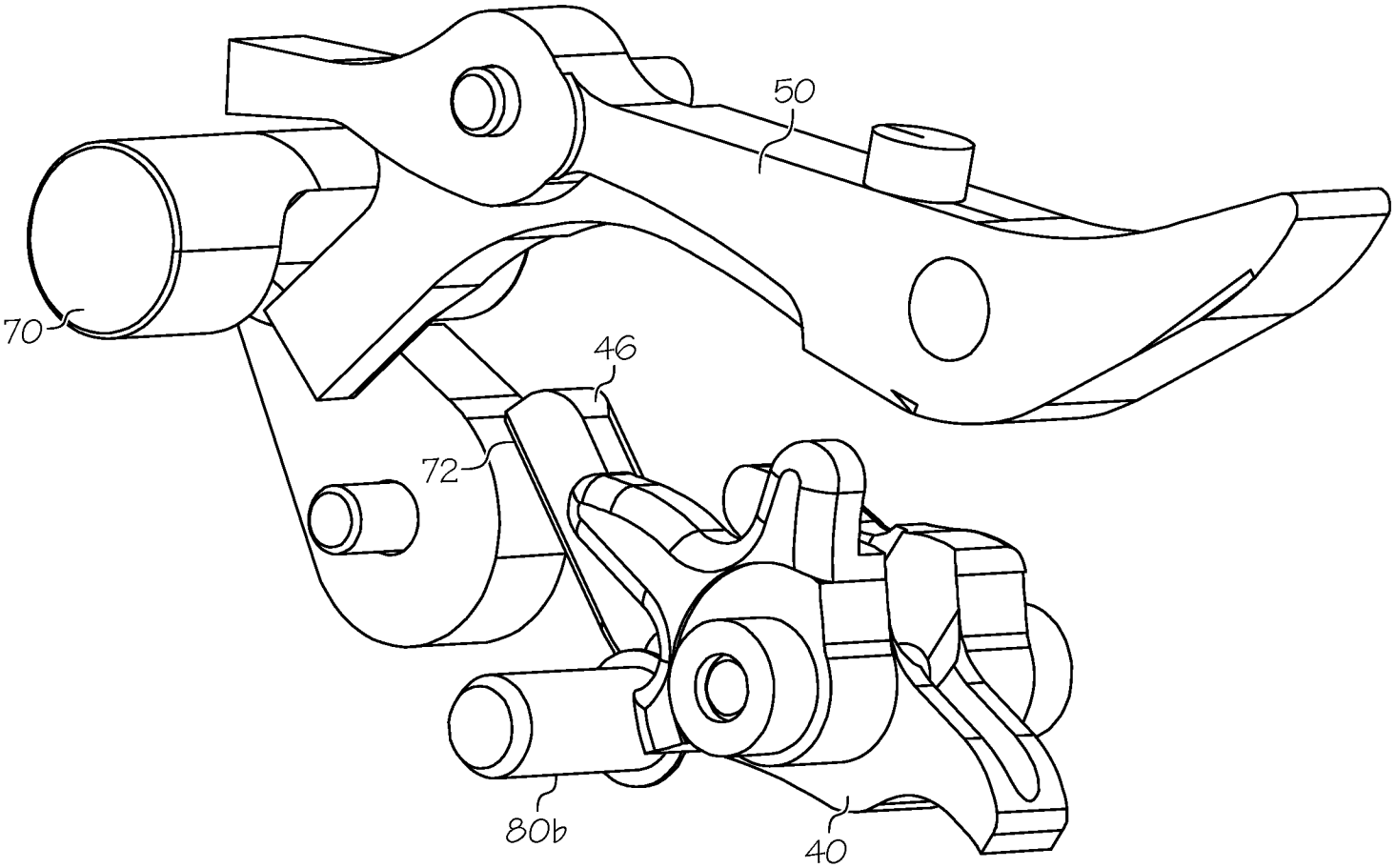
Figure 19:
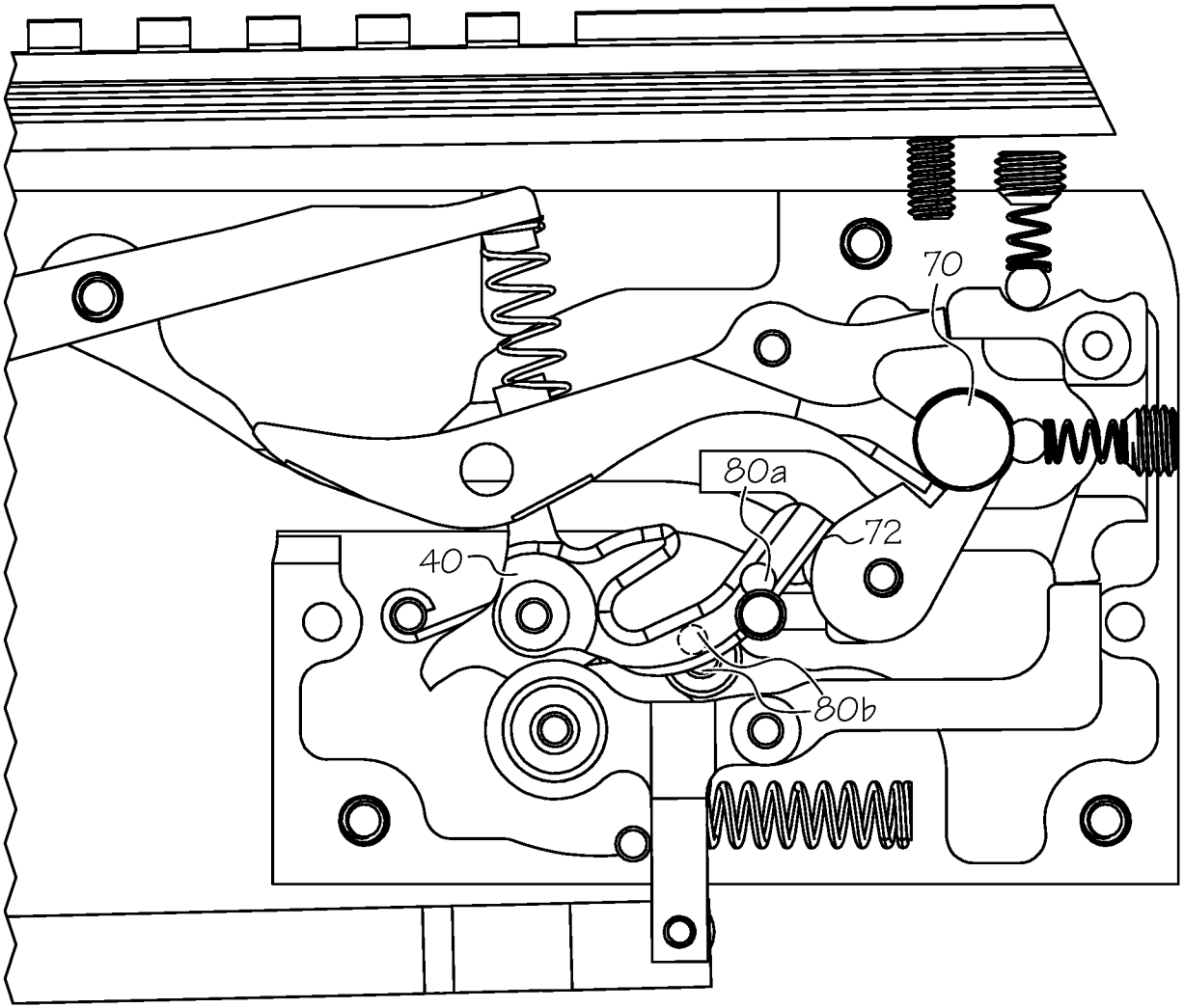

FIGS. 17-19 show embodiments of a trigger assembly 10 when the disengage selector 70 is in the first orientation. The trigger assembly is not in decocking mode. If the bowstring 12 is lifted in a way similar to the decocking operation, the latch 40 can still move away from its first position; however, the latch 40 is prevented from reaching its second position or engaging the latch retaining mechanism 80 due to contact with the disengage selector 70. In some embodiments, the latch 40 will contact another portion of the trigger assembly that prevents the latch 40 from reaching the second position. In some embodiments, the disengage portion 46 of the latch 40 will contact the latch interfering portion 72 of the disengage selector 70. Because the latch 40 cannot engage the latch retaining mechanism 80, as the bowstring 12 is let down, the latch 40 will return to its first orientation with the bowstring 12 retained by the catch portion 44 and the crossbow being cocked.

Referring to FIG. 2, in some embodiments, a portion of the safety 20 is oriented in the slot 82. As shown in FIG. 2, a portion of the safety 20 overlaps the slot 82 slightly when the safety is in its first position (e.g. a safe/no-fire position). That portion of the safety 20 will move farther into the slot 82 when the safety 20 is in its second position. In some embodiments, the bowstring 12 will contact the safety 20 during a cocking operation. For example, as the crossbow is drawn, the bowstring 12 will contact the safety 20 as the bowstring 12 reaches the rear of the slot 82. In some embodiments, if the crossbow is cocked with the safety 20 in its second position (e.g. live/fire mode), during cocking the bowstring will bias the safety 20 and move the safety to its first position (e.g. a safe/no-fire position).

Referring to FIGS. 10-12 and 14, in some embodiments, the trigger assembly 10 is arranged such that if the disengage selector 70 is in the second (e.g. decock) position, operation of the arrow sensor 50 can cause the disengage selector 70 to change position back to the first position. For example, in some embodiments, if the disengage selector 70 is in the second position (e.g. decock mode), inserting an arrow that causes movement of the arrow sensor 50 from the first position to the second position will bias the disengage selector 70 to move from its second position to its first position (e.g. standard mode).

In some embodiments, as the bowstring 12 passes through the slot 82, it will cause the arrow sensor 50 to move from the first position to the second position. Thus, if the crossbow is in a brace condition and a cocking procedure is attempted with the disengage selector 70 in the second position (e.g. decock mode), as the bowstring moves through the slot, it will bias the arrow sensor 50, which will bias the disengage selector 70 to its first position. The trigger assembly 10 will automatically switch from decocking mode back to normal operation mode during the cocking procedure as the bowstring moves past the arrow sensor 50, and the latch 40 will retain the bowstring in the cocked orientation. Also, during a decocking operation, as the bowstring 12 is lowered and moves past the latch 40 and arrow sensor 50, operation of the arrow sensor 50 will move the disengage selector 70 back to the first position (e.g. standard mode). Thus, in some embodiments, the decocking operation will automatically move the disengage selector 70 out of decocking mode.

In some embodiments, a surface 75 of the disengage selector 70 that contacts the arrow sensor 50 is oriented at a non-orthogonal angle to an axis of movement 71 of the disengage selector 70. The surface 75 can have any suitable shape and configuration that allows for proper interface with the arrow sensor 50. In some embodiments, the surface 75 is flat. In some embodiments, the surface 50 comprises curvature. The surface 75 can be oriented at any suitable angle to the axis 71. When the surface 75 comprises curvature, the portion(s) of the surface that contact the arrow sensor 50 can be oriented at any suitable angle.

In some embodiments, a surface 69 of the arrow sensor 50 that is arranged to contact the disengage selector 70 is angled or comprises curvature. In some embodiments, the surface 69 of the arrow sensor contacts the surface 75 of the disengage selector.

The entire disclosures of U.S. Pat. Nos. 8,991,375, 9,341,430 and 9,435,605 are hereby incorporated herein by reference.

The entire disclosure of U.S. patent application Ser. No. 15/347,662, filed Nov. 9, 2016, is hereby incorporated herein by reference.

In some embodiments, a trigger mechanism is described by the following numbered paragraphs:

1. A crossbow trigger mechanism comprising:
   a trigger comprising a trigger sear; and
   a latch comprising a latch sear, a string catch and a disengage portion, the latch sear arranged to contact the trigger sear.
2. The trigger mechanism of paragraph 1, comprising a detent arranged to engage the latch.
3. The trigger mechanism of paragraph 2, wherein the detent engages the disengage portion.
4. The trigger mechanism of paragraph 2, the latch comprising a reset portion.
5. The trigger mechanism of paragraph 4, wherein the string catch is located between the disengage portion and the reset portion.
6. A crossbow trigger comprising a latch, the latch rotatable about a latch axis, the latch comprising a string catch, a sear and a disengage portion, the string catch extending in a first radial direction, the sear extending in a second radial direction and the disengage portion extending in a third radial direction.
7. The crossbow trigger of paragraph 6, wherein an angle between the first radial direction and the third radial direction is less than an angle between the second radial direction and the third radial direction.
8. The crossbow trigger of paragraph 6, the latch further comprising a reset portion, the reset portion extending in a fourth radial direction.
9. A crossbow trigger comprising:
   a housing defining a slot arranged to receive a string;

a latch moveable between a first position and a second position, at least a portion of the latch oriented in the slot;

wherein the slot comprises a curved portion.

10. The crossbow trigger of paragraph 9, the latch comprising a disengage portion, at least a portion of the disengage portion oriented in the slot in the second position.

11. The crossbow trigger of paragraph 10, the disengage portion oriented in the curved portion in the second position.

12. The crossbow trigger of paragraph 10, the disengage portion oriented in the slot in the first position.

13. The crossbow trigger of paragraph 10, the latch comprising a catch, the catch not located in the slot in the second position.

14. The crossbow trigger of paragraph 9, the latch arranged to rotate about a latch axis, the curved portion concave with respect to the latch axis.

15. A crossbow trigger comprising:

an arrow sensor moveable between first and second orientations;

a disengage selector moveable between first and second positions;

wherein movement of the arrow sensor from the first orientation to the second orientation causes the disengage selector to move from the second position to the first position.

16. The crossbow trigger of paragraph 15, the disengage selector moving along an axis between the first and second positions, the disengage selector comprising a surface arranged to contact the arrow sensor, the surface oriented at a non-orthogonal angle to the axis.

17. The crossbow trigger of paragraph 15, comprising a latch and a retaining mechanism, the latch moveable between first and second orientations, the retaining mechanism arranged to retain the latch in its second orientation, wherein the disengage selector first position prevents the latch from moving to its second orientation.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow trigger comprising:

a trigger;

a latch, the latch rotatable about a latch axis, the latch comprising a string catch, a sear and a disengage portion, the sear arranged to contact the trigger, the string catch and the disengage portion defining a cavity, the cavity arranged to receive a bowstring;

a biasing member arranged to bias the latch to a first position; and a latch retaining mechanism arranged to retain the latch in a second position.

2. The crossbow trigger of claim 1, the latch retaining mechanism comprising a detent.

3. The crossbow trigger of claim 2, the disengage portion comprising the detent.

4. The crossbow trigger of claim 1, the disengage portion extending away from the latch axis, the disengage portion comprising curvature.

5. A crossbow trigger comprising:

a trigger; and a latch, the latch rotatable about a latch axis, the latch comprising a string catch, a sear and a disengage portion, the sear arranged to contact the trigger, the string catch and the disengage portion defining a cavity, the cavity arranged to receive a bowstring;

the latch further comprising a reset portion.

6. The crossbow trigger of claim 5, the reset portion located adjacent the string catch.

7. The crossbow trigger of claim 5, the string catch located between the disengage portion and the reset portion.

8. The crossbow trigger of claim 5, wherein an angle between the disengage portion and the reset portion is less than an angle between the string catch and the sear.

9. A crossbow trigger comprising:

a trigger;

a latch;

a safety arranged to move with respect to a first axis;

a disengage selector arranged to move with respect to a second axis;

wherein the first axis is nonparallel to the second axis.

10. The crossbow trigger of claim 9, wherein the first axis is orthogonal to the second axis.

11. The crossbow trigger of claim 9, the safety arranged to move along the first axis.

12. The crossbow trigger of claim 9, the disengage selector arranged to move along the second axis.

13. The crossbow trigger of claim 9, comprising an arrow sensor arranged to contact the disengage selector.

14. The crossbow trigger of claim 13, the arrow sensor arranged to contact the safety.

15. The crossbow trigger of claim 13, the arrow sensor arranged to prevent movement of the disengage selector.

* * * * *